United States Patent [19]

Neal, Jr.

[11] 4,254,455

[45] Mar. 3, 1981

[54] REFLECTOR FOR DENTAL, MEDICAL OR THE LIKE LIGHTING DEVICE

[75] Inventor: Eugene J. Neal, Jr., Clover, S.C.

[73] Assignee: Pelton & Crane Company, Charlotte, N.C.

[21] Appl. No.: 105,885

[22] Filed: Dec. 21, 1979

[51] Int. Cl.[3] ..... F21V 7/02

[52] U.S. Cl. ..... 362/296; 362/347; 362/804; 350/290

[58] Field of Search ..... 362/220, 293, 296, 297, 362/307, 308, 309, 310, 311, 343, 347, 348, 327, 804, 355; 350/290, 166, 1.5, 1.6, 1.7

[56] References Cited

U.S. PATENT DOCUMENTS

| | | | |
|---|---|---|---|
| 1,652,416 | 12/1927 | Schepmoes | 362/327 |
| 3,085,468 | 4/1963 | Hehn . | |
| 3,174,067 | 3/1965 | Bahrs | 350/1.5 |
| 3,191,023 | 6/1965 | Sullivan et al. | 362/220 |
| 3,527,974 | 9/1970 | Cooper | 362/293 |
| 3,588,488 | 6/1971 | Lauterbach . | |
| 3,645,600 | 2/1972 | Doctoroff et al. . | |
| 3,666,939 | 5/1972 | Ota . | |
| 3,704,928 | 12/1972 | Coombs et al. . | |
| 3,944,320 | 3/1976 | McLintic | 350/290 |
| 4,149,227 | 4/1979 | Dorman | 362/804 |
| 4,160,061 | 7/1979 | Okino et al. . | |
| 4,190,320 | 2/1980 | Ferro | 350/129 |

*Primary Examiner*—Donald A. Griffin
*Assistant Examiner*—Alan Mathews
*Attorney, Agent, or Firm*—Bell, Seltzer, Park & Gibson

[57] ABSTRACT

A reflector for use in a dental, medical or other lighting device wherein light from a light source is reflected thereby in a predetermined pattern for illumination of a desired zone. The reflector is formed of a glass substrate of predetermined shape for reflecting light in a predetermined pattern and has a dichroic coating on the front surface for reflecting a substantial portion of visible light and for allowing infrared and other undesirable energy along with some unreflected visible light to pass therethrough so that cool light only is reflected and a diffuser coating on the rear surface for diffusing light passing through the glass substrate to reduce undesirable glare from the rear of the reflector. The diffuser coating is preferably a ceramic frit.

4 Claims, 3 Drawing Figures

REFLECTOR FOR DENTAL, MEDICAL OR THE LIKE LIGHTING DEVICE

FIELD OF THE INVENTION

An improved reflector for use in a dental, medical or the like lighting device wherein light from a light source is reflected thereby in a predetermined pattern for illumination of a desired zone.

BACKGROUND OF THE INVENTION

In the broad field of light reflectors, it has generally been considered desirable to make such reflectors from metallic substrates. Lightweight metallic materials, such as aluminum, are easily formed to provide the desirable reflector configuations and are easily handled both in manufacturing and installation and do not require elaborate support structures and are not easily susceptible to damage. However, a noticeable problem of such metallic reflectors is that the metal acts not only to reflect visible light, but also to reflect ultraviolet, infrared and other undesirable energy and does not provide a "cool" light which is desirable in many uses of such reflectors.

Accordingly, in order to overcome this deficiency of metallic reflectors, particularly in the field of dental, medical or the like lighting devices, glass substrates have been adopted. As is well known, when properly coated with a dichroic coating, glass reflectors will satisfactorily reflect a substantial portion of visible light and allow infrared and other undesirable energy to pass through the glass reflector so that cool light only is reflected. While the use of a glass substrate with a dichroic coating thereon has overcome the problems set forth above with respect to metallic substrate reflectors and has produced a reflected cool light, other problems have been presented with commercial glass substrate reflectors with dichroic coatings thereon.

In this regard, the assignee of the present invention has heretofore quite successfully commercialized a lighting device for dental and surgical procedures, as disclosed in U.S. Pat. No. 3,191,023, which, although not fully disclosed in such patent, has utilized a reflector having a glass substrate of a predetermined shape set forth in such patent for reflecting light in a predetermined pattern and having a dichroic coating on the rear surface of the glass substrate for reflecting a substantial portion of visible light and for allowing ultraviolet, infrared and other undesirable energy along with some unreflected visible light to pass therethrough, so that cool light only is reflected.

By having the dichroic coating on the rear surface of the reflector, a problem of protection of such dichroic coating was presented inasmuch as the dichroic coating can be easily damaged by cleaning or handling of the reflector. Accordingly, the assignee of the present invention employed a protective TEFLON paint coating over the dichroic coating on the rear surface of the glass substrate of the reflector to aid in preventing damage to the dichroic coating.

This paint coating also advantageously served as a diffuser medium to diffuse light passing through the reflector to reduce undesirable glare from the rear of the reflector. Such glare is quite annoying and disrupting to a dentist, doctor or assistant who is utilizing such lighting device and the diffuser paint coating acts in a similar manner to a lampshade over an ordinary household lamp.

While this reflector was successful in the commercial lighting device of the assignee of the present invention and overcame the above problems, it provided a further problem in that after extended use of the lighting device and the reflector, peeling of the protective diffuser paint coating on the rear surface of the glass substrate occurred which also ultimately resulted in damage to the dichroic coating on such rear surface.

Another approach to prevent such damage to the dichroic coating has been utilized by others in the medical and dental lighting device business by providing what is termed a front surface reflector which utilizes a glass substrate and the dichroic coating on the front surface of the reflector so that such dichroic coating will not be subjected to damage from handling, etc. of the normally exposed rear surface of the glass reflector. The lighting device housing usually surrounds the front surface of the reflector and thereby provides some protection against damage to the dichroic coating.

However, such commercial, front surface reflectors used in medical or dental lighting devices have not heretofore provided any diffusing coating for overcoming the problem of undesirable glare emitting from the rear of the reflector and this has been one of the recognized problems in the industry of such front surface reflectors.

SUMMARY OF THE INVENTION

Accordingly, it is the object of the present invention to overcome the above defined problems with reflectors for use in dental, medical or other lighting devices.

It has been found by this invention that such problems may be overcome by providing such a reflector comprising, generally the following.

A glass substrate of predetermined shape is provided for reflecting light in a predetermined pattern and has a front surface and a rear surface. Dichroic coating means is provided on the front surface of the glass substrate for reflecting a substantial portion of visible light and for allowing infrared and other undesirable energy along with some unreflected visible light to pass through the glass substrate so that cool light only is reflected. Diffuser coating means is provided on the rear surface of the glass substrate for diffusing light passing through the glass substrate to reduce undesirable glare from the rear of the reflector.

As may be seen from the above solution to the object of this invention, the problems discussed above with prior commercial reflectors are overcome by this invention by (1) placing the dichroic coating on the front surface of the glass substrate of the reflector so as to prevent damage thereto from the rear of the reflector which is normally exposed to handling, etc. during use of the lighting device and (2) utilizing a diffuser coating on the rear surface of the reflector for diffusing undesirable glare from the rear of the reflector.

Problems presented with prior diffuser coatings on the rear surface of the reflector can be improved by the present invention inasmuch as moving of the dichroic coating to the front surface of the reflector renders a greater variety of protective paint coatings available for use on the rear surface of the reflector, which could not be utilized when the dichroic coating was on the rear surface of the reflector because of adverse chemical reaction with such dichroic coating. Such diffuser paint coatings which may now be utilized on the rear surface of the reflector include epoxy paints, etc. which are less susceptible to peeling.

Accordingly, in its broadest context, the present invention provides an improved reflector for use in a dental, medical or other lighting device which overcomes substantial problems produced with prior lighting devices and provides the combination of a glass substrate, a dichroic coating on the front surface thereof and a diffuser coating on the rear surface thereof. To applicant's knowledge, this novel combination in a reflector for use in a dental, medical or other lighting device has not been heretofore proposed.

Although the epoxy or other types of diffuser paint coatings overcame to a substantial degree the prior problem of peeling with such coatings, it was found by the present invention that some problem of peeling still existed. Accordingly, to overcome such remaining peeling problem, the present invention has more specifically proposed for the diffuser coating the use of a ceramic frit fused to the rear surface of the glass substrate of the reflector for diffusing light passing through the reflector and eliminating any problem of peeling.

Such ceramic frits have heretofore been utilized in household china, dinnerware, porcelain and other such products for providing a desired crushed glass coating thereon. However, to applicant's knowledge, a ceramic frit has never been utilized as a light diffusing medium in a reflector or any other type of optical system.

Accordingly, this invention in a more specific context provides for the use of a ceramic frit as the diffuser coating in the above novel combination in an improved reflector for dental, medical or other lighting devices.

BRIEF DESCRIPTION OF THE DRAWINGS

Some of the objects and advantages of the invention having been stated, other objects and advantages will appear when taken in conjunction with the accompanying drawings, in which.

DESCRIPTION OF ILLUSTRATED EMBODIMENT

Figure 1:
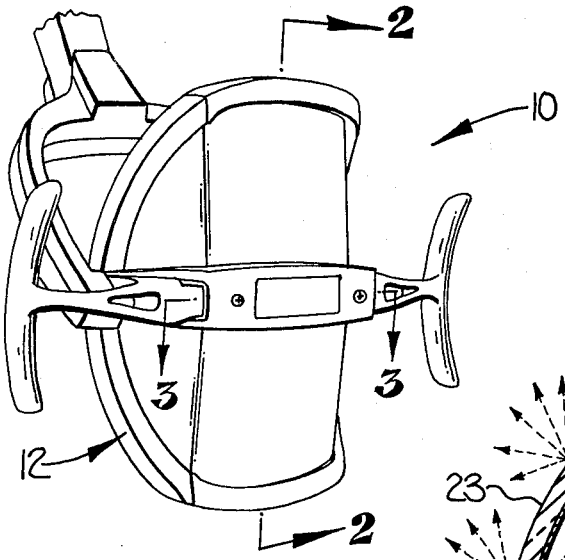
FIG. 1 is a perspective view of a dental or medical lighting device constructed in accordance with this invention and utilizing the reflector of this invention.

Referring now to the drawings, there is illustrated therein a lighting device, generally indicated by the reference numeral 10, which is applicable for dental, medical or the like uses to illuminate a desired zone of a patient.

The lighting device includes a frame 12 of a predetermined desired configuration and which may be constructed in accordance with assignee's co-pending application Ser. No. 105,888 filed concurrently herewith.

The lighting device 10 further includes a light source 14 which may be any conventional type of light bulb normally utilized in these types of lighting devices. The light source 14 is suitably carried by the frame 12 in the manner generally and schematically illustrated in FIGS. 2 and 3 and more particularly illustrated in assignee's aforementioned co-pending application.

Figure 2:
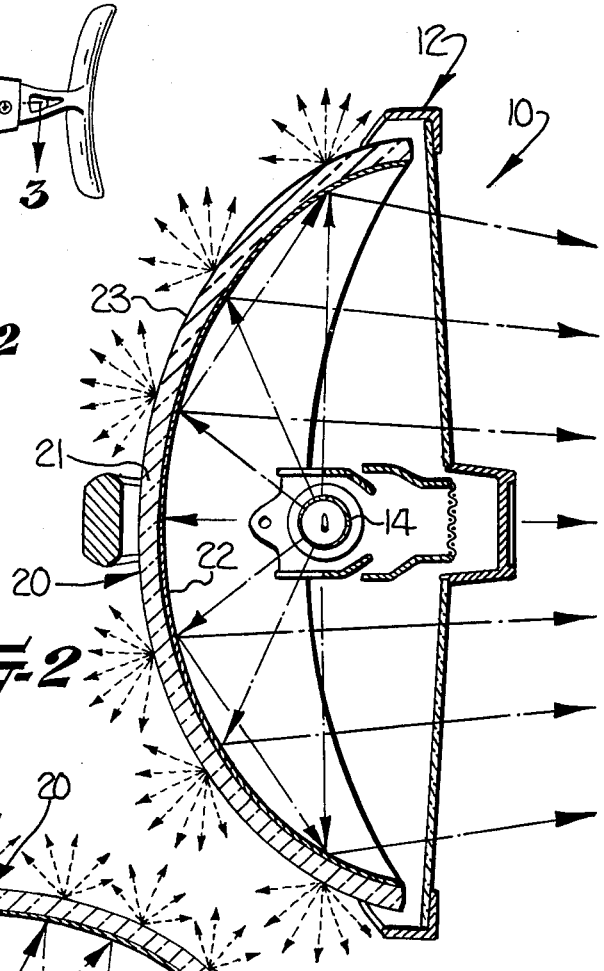
FIG. 2 is a sectional view of the lighting device of FIG. 1 and taken generally along the line 2—2 of FIG. 1 and schematically illustrating the flow of light in and through such lighting device.
Figure 3:
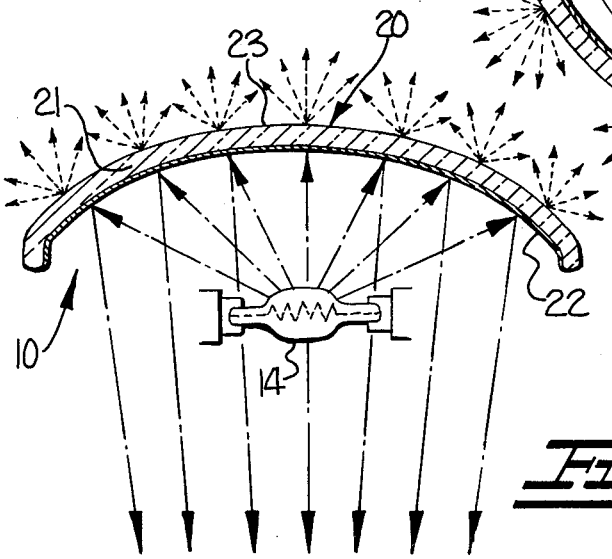
FIG. 3 is a sectional view through the lighting device of FIG. 1 and taken generally along the line 3—3 of FIG. 1, but, for purposes of clarity, omitting certain portions of the frame of the lighting device and illustrating schematically the pattern of light flow.

The lighting device further includes a reflector 20 suitably carried by the frame 12 and disposed behind the light source 14, as shown in FIGS. 2 and 3, for reflecting light in a predetermined pattern. The predetermined pattern of reflected light is determined by the shape of the reflector 20 and the positioning of the light source 14. These do not form a part of the present invention and will not be described in detail herein; however, the shape of the reflector and positioning of the light source may be in accordance with the teachings of U.S. Pat. No. 4,149,227, issued Apr. 10, 1979.

The reflector 20 comprises a glass substrate 21 of the predetermined shape of the reflector 20 and includes a front surface and a rear surface, as may be seen in the sectional views of FIGS. 2 and 3. A dichroic coating 22 is provided on the front surface of the glass substrate 21 of the reflector 20 for reflecting a substantial portion of visible light and for allowing infrared and other undesirable energy along with some unreflected visible light to pass through the glass substrate 21 so that only cool light is reflected.

"Dichroism" has been defined as the property of having different absorption coefficients for light polarized in different directions. A set forth above, dichroic coatings utilized on reflectors for the above purposes are well known to those will ordinary skill in the art and the specific composition, etc. of same do not form a part of the present invention.

As is well known, a conventional light source gives off energy in a wide range of wave lengths. It gives off ultraviolet energy, energy in the visible spectrum or light, infrared energy which is often thought of as heat, X-rays, etc. It is desirable to reflect only the visible energy or light so that the pattern of light reflected onto the predetermined zone of a patient in dental or medical use will be a cool light and will not be hot so as to adversely affect the illuminated region of the patient. Accordingly, the dichroic coating 22 will reflect only the visible light or cool light and will allow the other undesirable energy to pass through such coating and through the glass substrate 21 of the reflector 20.

Also, these dichroic coatings are not 100% efficient and some of the visible light will also pass therethrough and through the reflector 20. The unreflected visible light along with the other undesirable energy will appear as a red ball when viewing the rear of the reflector 20 or the lighting device 10 and is quite annoying to the dentist, doctor or assistant utilizing the lighting device 10. The effect may be analogized to looking into a lamp without a shade thereon.

Accordingly, in accordance with this invention, the lighting device 10 further includes a diffuser coating 23 on the rear surface of the glass substrate 21 of the reflector 20 for diffusing light passing through the glass substrate 21 to reduce undesirable glare from the rear of the reflector 20. This is similar to the effect achieved by placing a lampshade on a lamp. In the drawings, the reflecting of light, the passing of light through the substrate 21 and the diffusing of light by the diffuser coating 23 have been illustrated schematically by the arrows in FIGS. 2 and 3.

In accordance with a more specific aspect of the present invention and to avoid the abovenoted problem of peeling of the diffuser coating 23, it is preferred that such diffuser coating 23 comprise a ceramic frit.

"Ceramic frits" have been defined as a ground glass used in making glazes and enamels and formed by melting the ingredients and rapidly cooling them to convert water-soluble raw materials into an insoluble glass, making it easier to keep them uniformly distributed in the glaze or enamel during processing. These glazes or enamels, as discussed above, have been conventionally utilized in the field of manufacturing household china, dinnerware, porcelain and other products desiring a crushed glass coating thereon.

The particular manner in which the ceramic frit 23 is made and the process of fusing it to the rear surface of the glass substrate 21 of the reflector 20 do not form a part of this invention and such details will be known to those with ordinary skill in the art.

Thus, this invention has provided an improved reflector for a dental, medical or the like lighting device which overcomes problems set forth with prior lighting devices and presents novel combinations of structure not heretofore contemplated in this type of lighting device.

In the drawings and specification, there have been set forth preferred embodiments of the invention and although specific terms are employed, they are used in a generic and descriptive sense only and not for purposes of limitation.

What is claimed is:

1. A reflector for use in a dental, medical or other lighting device wherein light from a light source is reflected thereby in a predetermined pattern for illumination of a desired zone; said reflector comprising:

a glass substrate of predetermined shape for reflecting light in a predetermined pattern and having a front surface and a rear surface;

dichroic coating means on said front surface of said glass substrate for reflecting a substantial portion of visible light and for allowing infrared and other undesirable energy along with any unreflected visible light to pass through said glass substrate so that cool light only is reflected; and diffuser coating means on said rear surface of said glass substrate for diffusing light passing through said glass substrate to reduce undesirable glare from the rear of said reflector.

2. A reflector for use in a dental, medical or other lighting device wherein light from a light source is reflected thereby in a predetermined pattern for illumination of a desired zone; said reflector comprising:

a glass substrate of predetermined shape for reflecting light in a predetermined pattern and having a front surface and a rear surface;

dichroic coating means on said front surface of said glass substrate for reflecting a substantial portion of visible light and for allowing infrared and other undesirable energy along with any unreflected visible light to pass through said glass substrate so that a cool light only is reflected; and ceramic frit coating means fused to said rear surface of said glass substrate for diffusing light passing through said glass substrate to reduce undesirable glare from the rear of said reflector.

3. A lighting device for illuminating a desired zone of a patient to facilitate dental, medical or the like procedures, said lighting device comprising:

a frame of predetermined desired configuration;

a light source carried by said frame for providing light when energized; and a reflector carried by said frame and disposed behind said light source for reflecting the light from said light source in a predetermined pattern and comprising a glass substrate of predetermined shape having a front surface adjacent said light source, and a rear surface, dichroic coating means on said front surface of said glass substrate for reflecting a substantial portion of visible light and for allowing infrared and other undesirable energy along with any unreflected visible light to pass through said glass substrate so that cool light only is reflected, and diffuser coating means on said rear surface of said glass substrate for diffusing light passing through said glass substrate to reduce undesirable glare from the rear of said reflector.

4. A lighting device, as set forth in claim 3, in which said diffuser coating means on said rear surface of said glass substrate comprises a ceramic frit.

* * * * *